US007218196B2

(12) United States Patent
Nakao et al.

(10) Patent No.: US 7,218,196 B2
(45) Date of Patent: May 15, 2007

(54) NONCONTACT COUPLER

(75) Inventors: Fumiaki Nakao, Shizuoka (JP); Yoshio Matsuo, Aichi (JP); Mikio Kitaoka, Shizuoka (JP); Katsuo Yamada, Shizuoka (JP); Hiroshi Sakamoto, Kumamoto (JP)

(73) Assignee: FDK Corporation, Tokyo (JP)

( * ) Notice: Subject to any disclaimer, the term of this patent is extended or adjusted under 35 U.S.C. 154(b) by 124 days.

(21) Appl. No.: 10/467,871

(22) PCT Filed: Feb. 14, 2002

(86) PCT No.: PCT/JP02/01257

§ 371 (c)(1),
(2), (4) Date: Jan. 8, 2004

(87) PCT Pub. No.: WO02/065493

PCT Pub. Date: Aug. 22, 2002

(65) Prior Publication Data

US 2004/0119576 A1 Jun. 24, 2004

(30) Foreign Application Priority Data

Feb. 14, 2001 (JP) ..... 2001-037489
Jul. 10, 2001 (JP) ..... 2001-209347

(51) Int. Cl.
*H01F 27/02* (2006.01)

(52) U.S. Cl. ..... 336/83; 336/178

(58) Field of Classification Search ..... 336/83, 336/212, 229, 130–131, 178
See application file for complete search history.

(56) References Cited

U.S. PATENT DOCUMENTS 3,205,485 A * 9/1965 Noltingk ..... 340/870.32
2002/0033748 A1* 3/2002 Bolotinsky et al. ..... 336/182

FOREIGN PATENT DOCUMENTS

| | | |
|---|---|---|
| DE | 4 115 867 A1 * | 11/1992 |
| JP | 02-031405 | 2/1990 |
| JP | 2000-150273 | 5/2000 |

OTHER PUBLICATIONS

International Search Report for PCT/JP02/01257; date of mailing May 28, 2002; ISA/JPO.

* cited by examiner

*Primary Examiner*—Tuyen T. Nguyen
(74) *Attorney, Agent, or Firm*—Harness, Dickey & Pierce, PLC

(57) ABSTRACT

A noncontact coupler comprising a pair of magnetic cores 1, 1 each having a U-shaped open magnetic path, a primary coil L1 and secondary coil L2 being wound around said cores 1, 1 separately respectively, said coupler transmitting AC electric power between said primary and secondary coils L1, L2 by means of an annular closed magnetic path B formed by opposing in proximity both open magnetic face sides of said cores, wherein said primary and secondary magnetic cores 1, 1 are respectively split at least at their sides facing to each other, and a gap forming a spatial magnetic path is interposed between said split pieces. A diameter a of a medium leg 51 positioned inside an annular groove 52 around in which the coils L1, L2 are wound (housed) is set almost equal to a width b of the annular groove 52. These provide effects of lightening a noncontact coupler while securing its performance and improving handleability with enhancing tolerance for positioning of the primary and secondary cores.

9 Claims, 17 Drawing Sheets

PLAN VIEW

A-A CROSS-SECTION

A-A CROSS-SECTION

PLAN VIEW

A-A CROSS-SECTION

A-A CROSS-SECTION

EQUIVALENT CIRCUIT

EQUIVALENT CIRCUIT

PLAN VIEW

A-A CROSS SECTION t 1 : average thickness along A
t 2 : average thickness along B
t 3 : average thickness along C $t1 \times A = t2 \times B$
$t1 = t2$

PLAN VIEW

A-A CROSS SECTION

EXAMPLE 1

PERSPECTIVE VIEW

EXAMPLE 2

LATERAL CROSS-SECTIONAL VIEW

PLAN VIEW

A-A CROSS-SECTIONAL VIEW (a = b)

CUTAWAY PERSPECTIVE VIEW (a = b)

PLAN VIEW

CROSS SECTION

EQUIVALENT CIRCUIT

A : a = b
B : a = b ± 20%
C : a > b + 20%

PLAN VIEW

A-A CROSS SECTION

A-A CROSS SECTION

EQUIVALENT CIRCUIT

EQUIVALENT CIRCUIT

CUTAWAY PERSPECTIVE VIEW

PLAN VIEW

CROSS-SECTIONAL VIEW

EQUIVALENT CIRCUIT

VIEWED AT A-A

NONCONTACT COUPLER

FIELD OF THE INVENTION

This invention relates to a noncontact coupler using magnetic coupling technique. For example, this invention is useful to supply power to or charge an electronic apparatus such as an electric car without contacting.

BACKGROUND ART

A noncontact coupler using magnetic coupling technique is used as a means of supplying power to or charging an electric car, electric bicycle or other electric apparatuses.

FIGS. 16A–16D illustrate a structure of a prior art noncontact coupler. In this figure, FIG. 16A is a perspective view of a magnetic core 1', FIG. 16B is a plan view of FIG. 16A; FIG. 16C is a cross-sectional view of a noncontact coupler using the core 1'; and FIG. 16D is an equivalent circuit of the same.

As shown in the figures, the noncontact coupler includes a pair of magnetic cores 1', 1', each of which forming a U-shaped open magnetic path, and a primary coil L1 and a secondary coil L2 separately wound around the respective cores. The cores 1', 1' are opposed to each other with both open magnetic face sides of the respective cores 1', 1' in proximity to form an annular closed magnetic path B to allow the primary coil and the secondary coil to transmit AC power (high frequency power) to each other.

In this case, the core 1' in which the primary coil L1 is wound corresponds to a primary of a transformer and the core 1' in which the secondary coil L2 is wound corresponds to a secondary of a transformer respectively. The primary and the secondary are closely located each other at the interval of d and work as though it constituted one transformer.

The magnetic core 1', 1' is made of for example a ferrite magnetic body and integrally formed in a disc-shape. At one side of said disc magnetic core 1', a circular groove 52 is formed so that the coil L1, L2 is wound (received) therein, and the U-shaped open magnetic path is formed as detouring around the circular groove 52. Inside the annular groove 52, namely in the center of the disc, is formed a medium leg 51 which forms one pole face of the U-shaped open magnetic path. On the other hand, an outer circumference of the annular groove 52, namely outside of the disc, is formed an annular outer leg 53 and the other pole face of the U-shaped open magnetic path.

In the above noncontact transmission coupler, it is necessary to strengthen the magnetic coupling between the primary coil and the secondary coil for improving efficiency of power transmission. In other words, it is necessary to keep the magnetic coupling coefficient between the primary/secondary as high as possible. Then, in the prior art, a magnetic coupling was maximized between the cores 1', 1' by means of enlarging the area of the pole face (pole area) as large as possible. Because the wider the area of magnetic surface facing to each other is made, the tighter the magnetic coupling becomes. Therefore, the cores 1', 1' are formed in a solid integral structure, namely filled structure, having no void as a whole and to have a large magnetic pole area as large as possible. See Japanese Patent Application Laid-open Publication No. 2000-150273.

In the noncontact coupler, there were some problems as to its characteristics and structure stated below.

Namely, the structure confining the magnetic path B into the magnetic cores 1', 1' each having a filled integral structure can get high coefficient of the magnet coupling when both the magnetic cores 1', 1' are faced to each other concentrically. However, as shown in FIGS. 17A, 17B, when a lateral displacement (side displacement) arises between both the magnetic cores 1', 1', then the coupling coefficient fairly decrease by the lateral displacement h. Convenience in handling of the noncontact coupler will be deteriorated when the changing rate of the coupling coefficient for the displacement is large, because positioning between the primary and secondary requires accuracy.

Further, most weight of the noncontact coupler owes the magnetic cores (1', 1') of solid integral structure, increase in weight was unavoidable and this interrupted attempt to lighten the noncontact coupler.

The first object of the present invention is to improve usability of the noncontact coupler while securing its performance.

The second object of the present invention is to improve usability of the noncontact coupler by means of lightening the weight while securing its performance.

The third object of the present invention is to improve usability of the noncontact coupler by broadening tolerance in positioning of the primary and secondary cores.

Other objects and features according to the invention described above would be made clear by the following description of the specification and drawings.

DISCLOSURE OF THE INVENTION

The present invention discloses following techniques in order to accomplish the above stated objects.

The first main technique of the invention lies in a noncontact coupler comprising a pair of magnetic cores each having a U-shaped open magnetic path, a primary coil and secondary coil being wound around said cores separately respectively, said coupler transmitting AC electric power between said primary and secondary coils by means of an annular closed magnetic path formed by opposing in proximity both open magnetic face sides of said cores, wherein said primary and secondary magnetic cores are respectively split at least at their sides facing to each other, and a gap forming a spatial magnetic path (a magnetic path formed in a space) is interposed between said split pieces.

According to the above technique, a magnetic coupling between the primary coil and the secondly coil is established not only on a tip of each split core but also in a wide area extending over the side surface thereof. Namely, opposing surface area of the primary and secondary cores is substantially increased, and a magnetic circuit in a direction perpendicular to an original magnetic path (a winding direction of the coil) is to be shut off. Therefore, even if both the cores are displaced each other laterally, the magnetic coupling between the primary coil and the secondary coil can be maintained. At the same time, a total weight of the core is lightened by splitting the core. This can achieve both of the objects in lightening the noncontact coupler while securing its performance and improving handleability with enhanced tolerance for the primary and secondary core positioning.

Moreover, in the above technique, following aspects are efficient.

Namely, each of the primary and the secondary magnetic cores may be formed with a plurality of core members and the gaps may be interposed between the respective core members. The primary and the secondary magnetic cores may be formed with fan-shaped core members respectively, and fan-shaped gaps having the same shape as the respective core members can be interposed between each of the core members. The primary and the secondary magnetic cores may be formed with a plurality of elongated core members arranged radially to form a circle. The elongated core members may be board-shaped with entire uniform thickness. These embodiments are efficient for improvement in productivity and reducing weight. It is also effective for improvement in uniformity and stability of characteristics by means of optimizing the conditions of forming and burning for pressure forming and burning the core members.

The primary and the secondary magnetic core may be formed with the core members of the same odd number arranged radially to form a circle at equiangular intervals, the primary and the secondary core members are arranged to be superposed on the gaps between the opposed core members, so that in this state, magnetic couple between the primary coil and the secondary coil is formed. By means of the arrangement, decrease of the coefficient of the magnet coupling for a lateral displacement in a particular direction is further relieved.

The second main technique of the invention is a noncontact coupler comprising a pair of magnetic cores each having a U-shaped open magnetic path, a primary coil and secondary coil being wound around said cores separately respectively, said coupler transmitting AC electric power between said primary and secondary coils by means of an annular closed magnetic path formed by opposing in proximity both open magnetic face sides of said cores, wherein said primary and secondary magnetic cores are respectively formed with annular outer circumferential core members, disc-shaped inner circumferential core members, and a number of intermediate core members arranged radially to form a circle as connecting both said core members.

According to the technique, the invention enables to lighten the core while decreasing a variation of a cross section in a direction of a magnetic path. Namely, the present invention improves a balance in a magnetic path and decreases a core loss. Further, in the above technique, following embodiments are effective for example.

Namely, an inner circumferential edge of each of the intermediate cores may be tapered. An outer circumferential edge of the intermediate core members may be broadened in the width. Both of these embodiments can achieve reducing a weight of the core and optimize a balance of a magnetic path.

The third main technique of the invention is a noncontact coupler comprising a pair of magnetic cores each having a U-shaped open magnetic path, a primary coil and secondary coil being wound around said cores separately respectively, said coupler transmitting AC electric power between said primary and secondary coils by means of an annular closed magnetic path formed by opposing in proximity both open magnetic face sides of said cores, wherein a non-opposing corner of each of said primary and secondary magnetic core is beveled.

In the above technique, by means of removing a part of the core where magnetic flux density is low, it has become possible to lighten the core namely, to lighten the noncontact coupler, and to decrease a core loss by improving a balance of a magnetic path.

The fourth main technique of the invention is a noncontact transmit coupler comprising a pair of disc-shaped magnetic cores each having an annular groove for winding a coil on one side, said magnetic cores being faced to each other at the surfaces of said annular groove in order to transmit electric power from a coil of one core to a coil of the other core by means of magnetic coupling, wherein a diameter of a medium leg positioned inside the annular groove is set almost equal to a width of said annular groove.

The techniques enable to improve handleability with enhancing tolerance for the primary and secondary core positioning. In this case, preferably, difference between the width of the annular groove and the diameter of the medium leg will be within ±20%.

Moreover, in the above techniques, the core loss is minimized because of an appropriate balance of a magnetic path when an area of a pole face formed with the medium leg and an area of a pole face formed with the annular outer leg positioned outside the annular groove are made generally equal to each other. In this case, difference between the area of the pole face formed with the medium leg and the area of the pole face formed with the outer leg may be preferably within ±20%.

The magnetic core may be of a disc-shaped integral-type, or may be formed with a plurality of the split cores in order to form a disc shape as a whole. Further, in the case of the magnetic core is formed in order to form a disc shape as a whole, fan-shaped gaps can be positioned between the respective split cores. These fan-shaped gaps enable to reduce a weight of the core and to achieve an effect to keep a magnetic coupling coefficient high when the displacement exists.

The magnetic cores can be made of ferrite magnetic material. The weight of the core can be decreased by beveling the non-opposed corners of the primary and the secondary magnetic cores, and risk of suffering damage at a peripheral end of the core can be reduced. Further, this embodiment is effective to lighten the noncontact coupler and reduce the core loss by improving a magnetic path balance.

BEST MODE FOR CARRYING OUT THE INVENTION

First Embodiment

Figure 1A:
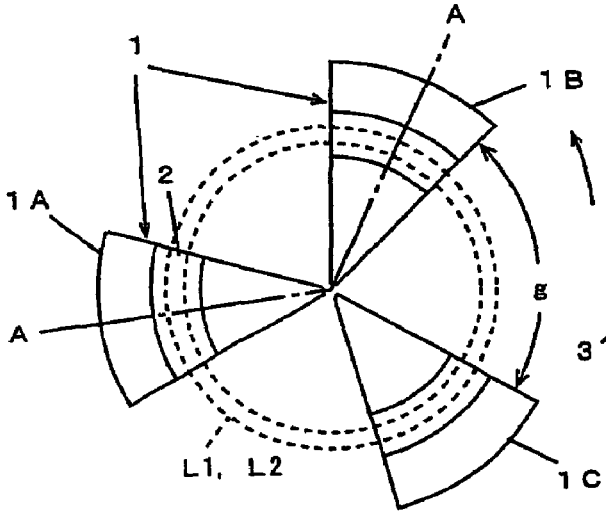
FIGS. 1A–1E show various aspects of a noncontact coupler according to the first embodiment of the present invention.
Figure 1B:
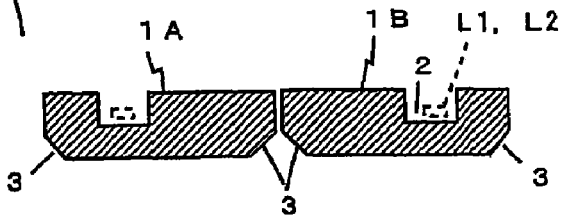
Figure 1C:
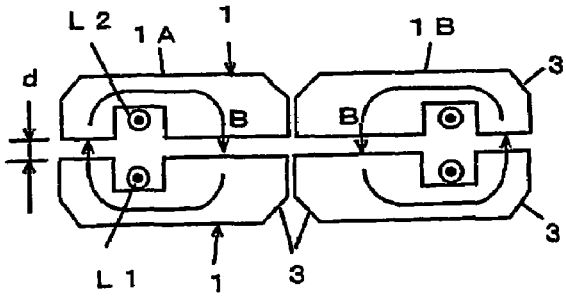

FIGS. 1A–1C show the first embodiment of the noncontact coupler in the present invention.

As shown in the figures, in the noncontact coupler according to the first embodiment, the primary and the secondary magnetic cores 1, 1 are formed with fan-shaped core members 1A, 1B, and 1C, each of which having a central angle of 45°, and fan-shaped gaps, each of which being the same shape as the core member (g=75°), are interposed between each of the core members 1A, 1B, and 1C. The core members 1A, 1B, and 1C have U-shaped grooves 2 on one sides to form U-shaped open magnetic paths.

The primary core members 1A, 1B, and 1C and the secondary core members 1A, 1B, and 1C are opposed in proximity at their open magnetic path sides so as to form annular closed magnetic paths B to allow the primary coil L1 and the secondary coil L2 to transmit AC power (high frequency power) to each other as a noncontact coupler.

Figure 1D:
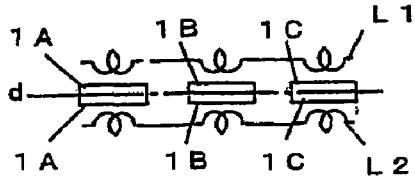
Figure 1E:
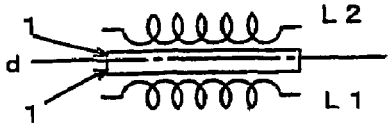

In this case, the respective pairs of the primary and secondary core members 1A—1A, 1B—1B, and 1C—1C are magnetically coupled, and form an equivalent circuit to a transformer as shown in FIG. 1D or FIG. 1E.

In this way, the noncontact coupler wherein at least the parts facing to each other of the primary and the secondary magnetic cores 1, 1 are split, and the gap g for forming a spatial magnetic path (a magnetic path formed in space) is interposed between the split parts, is formed. The noncontact coupler loses as much weight as the fan-shaped gap (g=75°).

The non-opposing corner of the each core member 1A, 1B, and 1C is beveled beforehand. The symbol 3 shows the beveled portions. These beveled portions enable the core 1, 1 to be further lightened and make it less possible to be damaged at the peripheral edge of the non-opposing corner.

Usually, a core member is made of a ferrite magnetic body produced by pressure forming and burning, and the ferrite magnetic body is generally brittle, so that easily damaged in manufacturing, conveying, or assembling process at the peripheral edges thereof. However the bevels 3 are effective to prevent the damage. Further, there are difficulties in manufacture for a large sized ferrite core, such as to pressure uniformly in a pressure forming process, and to be vulnerable to cracking in a burning process. These problems are solved by forming the core as divided disclosed above.

Figure 2:
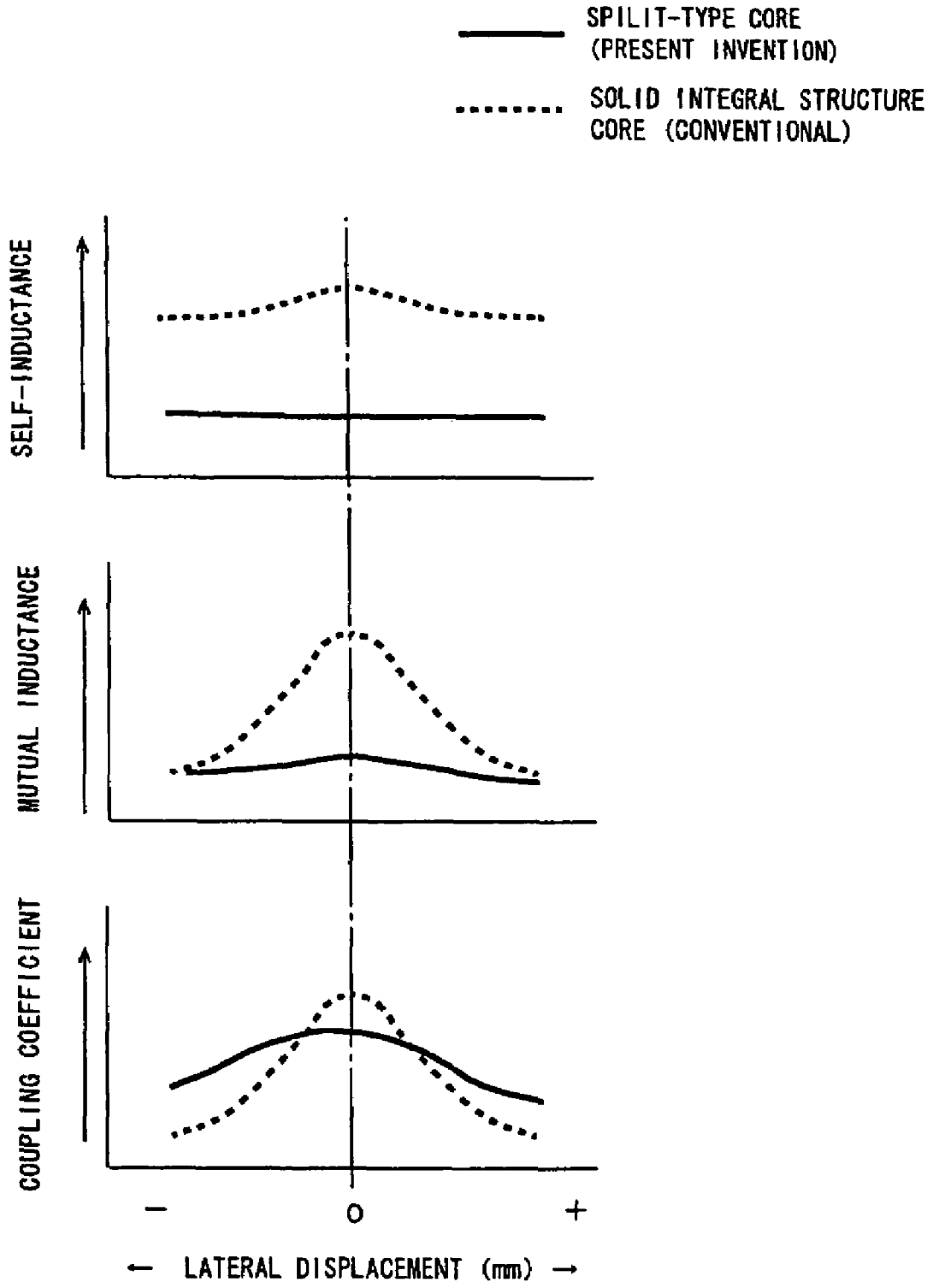
FIG. 2 is a graph which shows variation of a coupling coefficient for a lateral displacement with respect to the noncontact coupler shown in FIGS. 1A–1E.

FIG. 2 shows a change in characteristic for a lateral displacement of the noncontact coupler shown in FIG. 1.

Figure 17A:
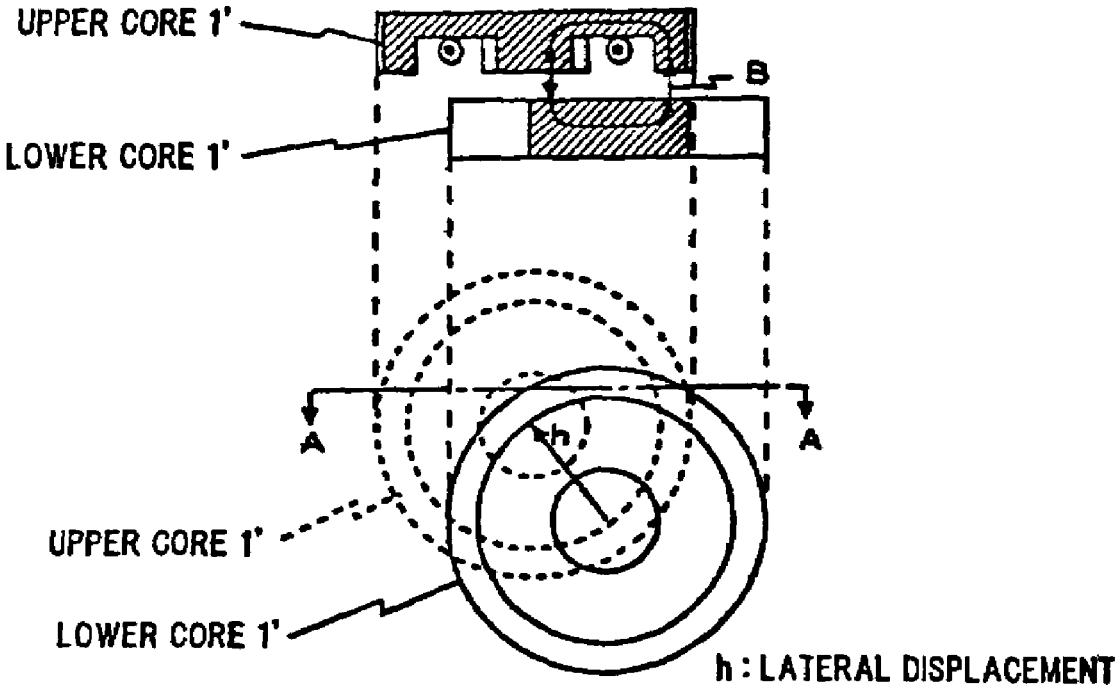
FIGS. 17A and 17B show a graph illustrating a state where a lateral displacement exists in a conventional noncontact transmit coupler.
Figure 17B:
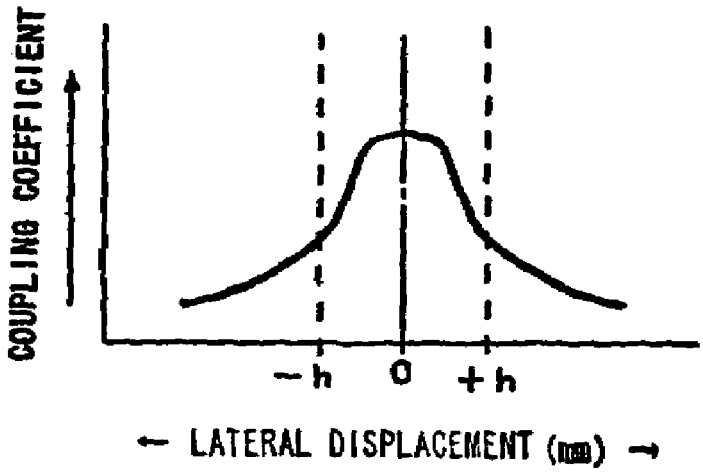

In the figure, solid lines show characteristic curves for the noncontact coupler according to the present invention shown in FIG. 1, on the other hand broken lines show characteristic curves of the conventional noncontact coupler shown in FIGS. 16, 17 respectably. As shown in the figure, compared to the conventional noncontact coupler, a self-inductance and a mutual-inductance for the coils L1, L2 of the noncontact coupler shown in FIG. 1 have become low respectively as a whole, while reduction rate of the inductance when the position of the primary and the secondary cores is displaced in a lateral direction has significantly decreased. And the coupling coefficient between the primary coil L1 and the secondary coil L2 is not so changed compared to the prior ones on the average, however it has been clear that change for the lateral displacement (a displacement in a lateral direction) is substantially reduced.

Figure 3A:
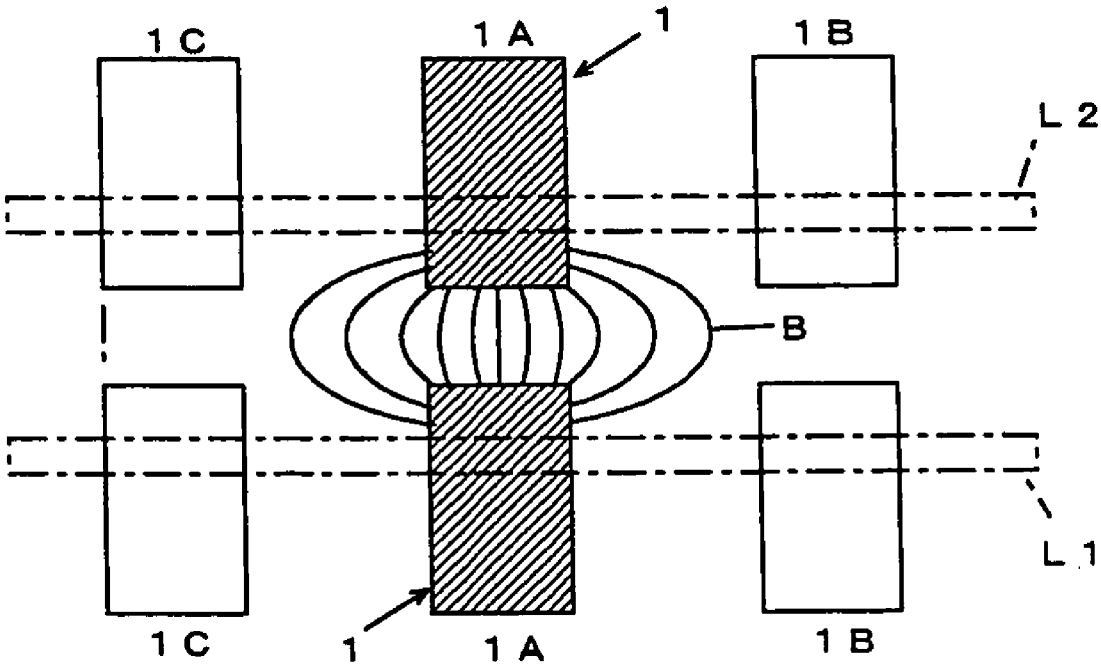
FIGS. 3A–3B show schematic views of a state of the spatial magnetic path in the noncontact coupler shown in FIGS. 1A–1E.
Figure 3B:
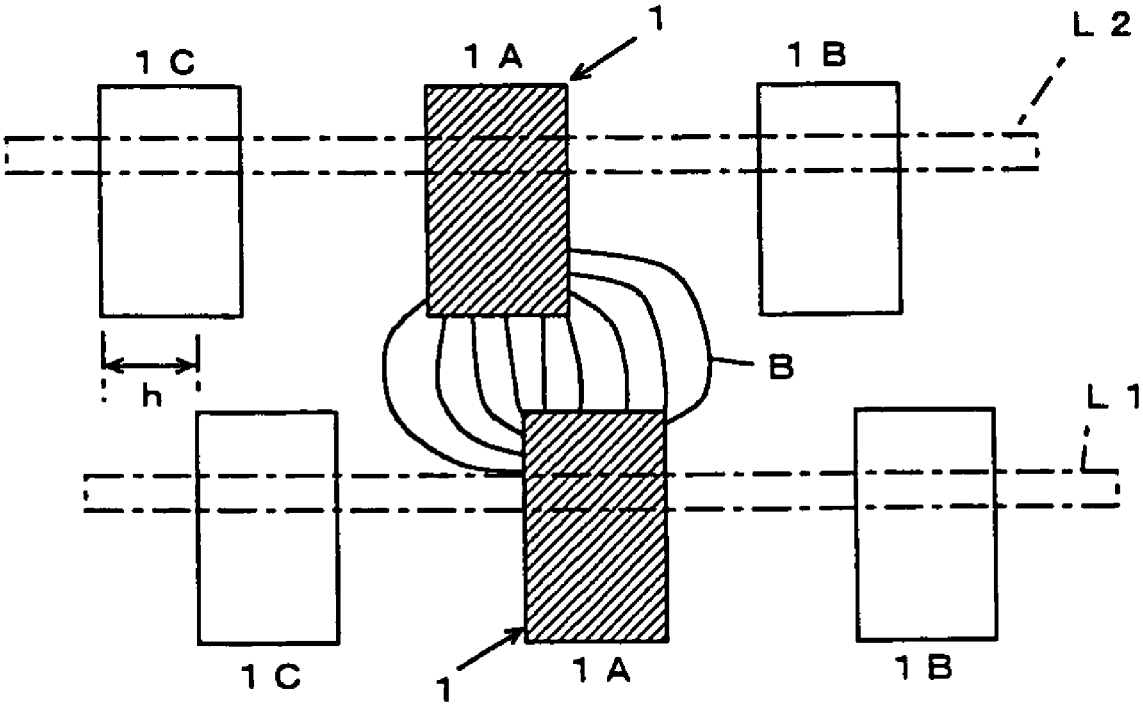

FIG. 3 schematically shows a state of spatial magnetic path when the lateral displacement h arises in the noncontact coupler shown in FIG. 1. As shown in the figure, where each primary and secondary magnetic core 1, 1 is split, the magnetic coupling between the primary core 1 and the secondary core 1 is established, not only at the tip surfaces of the split core members 1A, 1B, and 1C, but also in a wide range extending over both the tip surfaces and the side surfaces. Accordingly, effective facing areas between the primary and secondary cores 1, 1 are enlarged and the effective facing surfaces are maintained in the case of the lateral displacement h, and it is prevented that a magnetic circuit perpendicular to preferable magnetic paths (in a winding direction of the coil) from forming. In consequence, even if the lateral displacement occurs between both cores, the primary and the secondary magnetic connection can be maintained. At the same time, a total weight of the core can be lightened because of the split cores.

These steps provide effects of lightening the noncontact coupler while securing its performance and improving handleability with allowances for the primary and the secondary core positioning.

Figure 4A:
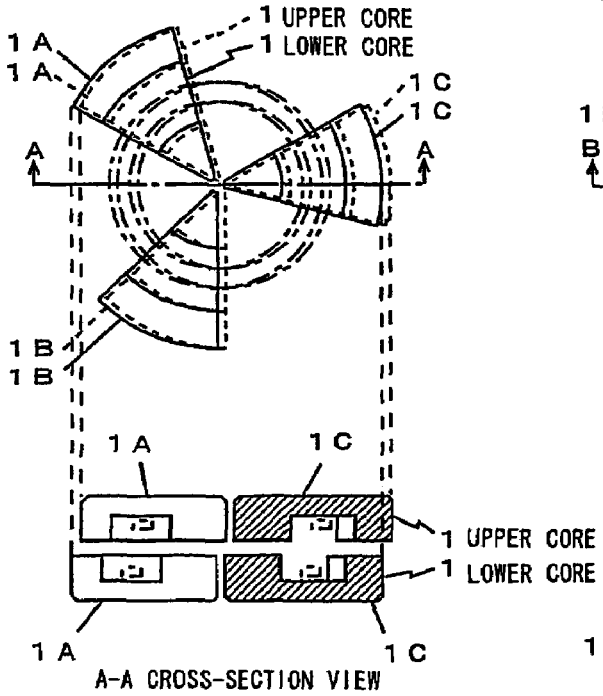
FIGS. 4A and 4B show examples of arrangement of the core members in the noncontact coupler shown in FIGS. 1A–1E.

FIG. 4-A and FIG. 4-B show an example of arrangement of the noncontact coupler using the magnetic cores 1, 1 shown in FIG. 1. In the figure, any of the primary and the secondary magnetic cores 1, 1 is formed with the core members 1A, 1B, 1C of the same odd-number (3 in this case), arranged radially at predetermined angular intervals so as to form a circle. In this case, there are two ways of arrangements for the core members 1A, 1B, and 1C, forming the primary core (upper core 1) and the core members 1A, 1B, and 1C, forming the secondary core (lower core 1) as shown in FIG. 4-A or FIG. 4-B.

Namely, in the arrangement shown in FIG. 4-A, the core members 1A, 1B, and 1C, forming the upper core 1 and the core members 1A, 1B, and 1C, forming the lower core 1 are arranged to be piled up each other, and, in this state, the noncontact coupler magnetically coupled with the primary coil and the secondary coil is formed.

And, the arrangement shown in FIG. 4-B the core members 1A, 1B, and 1C, forming upper core 1 and the core members 1A, 1B, and 1C, forming lower core 1 are arranged corresponding to the gaps between the opposing core members. In this arrangement, the noncontact coupler is formed by a magnetic coupling between the primary coil and the secondary coil.

Figure 4B:
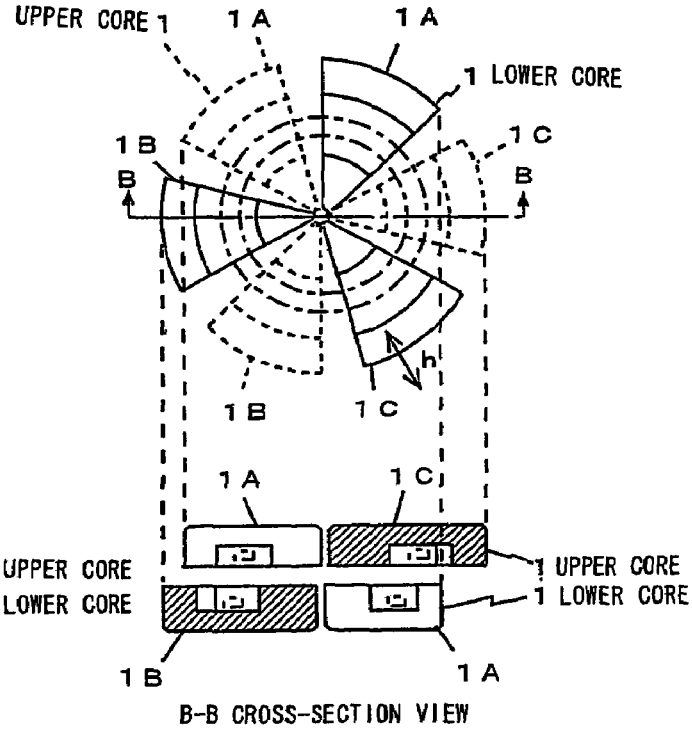

Here, in the configuration of FIG. 4B, it is possible to decrease a reduction rate of the opposing surface area when the upper and lower cores 1, 1 are displaced in the direction of an arrow (h), thus to further relieve a reduction rate of the coupling coefficient for the lateral displacement. Therefore, in the use for large lateral displacement in the direction of the arrow (h) is expected, the non contact coupler may preferably be formed according to the arrangement shown in FIG. 4-B.

Second Embodiment

Figure 5A:
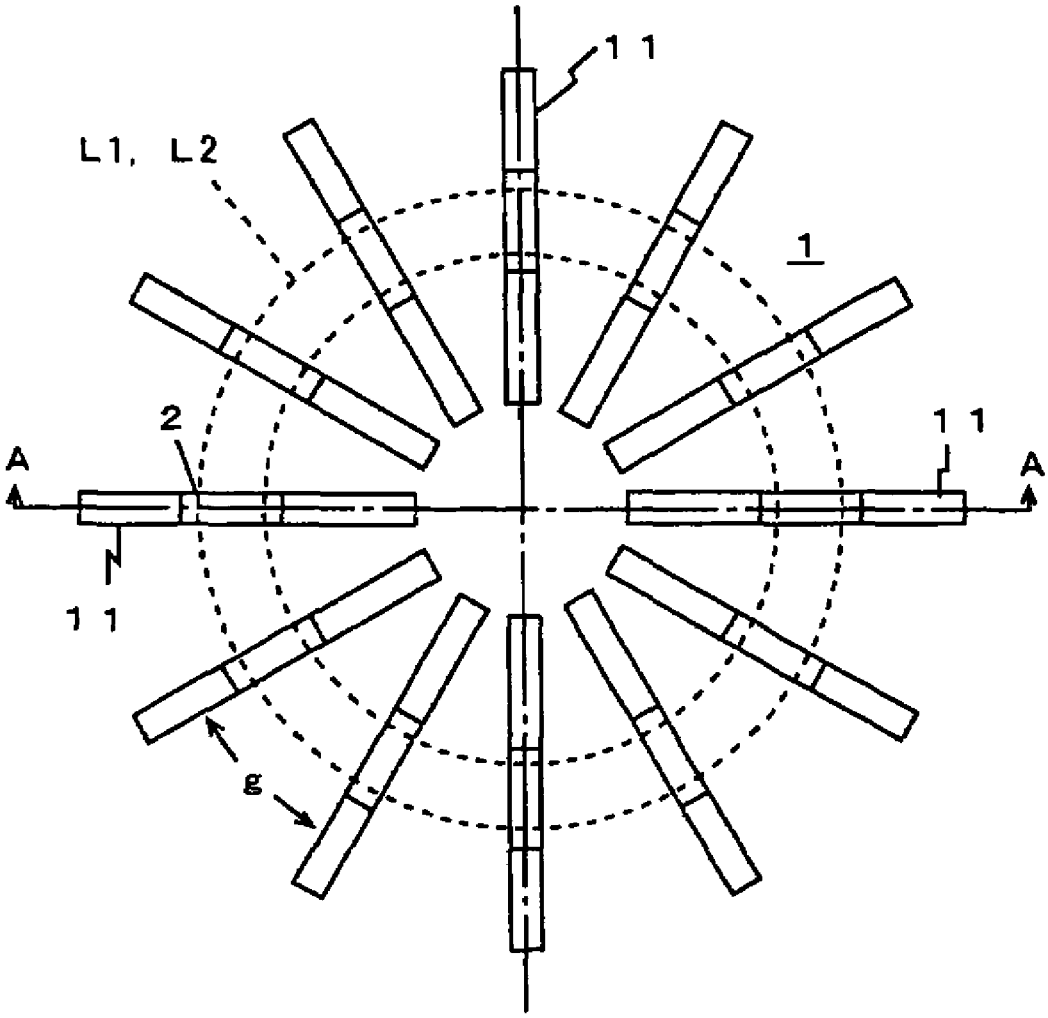
FIGS. 5A–5B show a plan view and a cross-sectional view of the second embodiment in the present invention respectively.
Figure 5B:
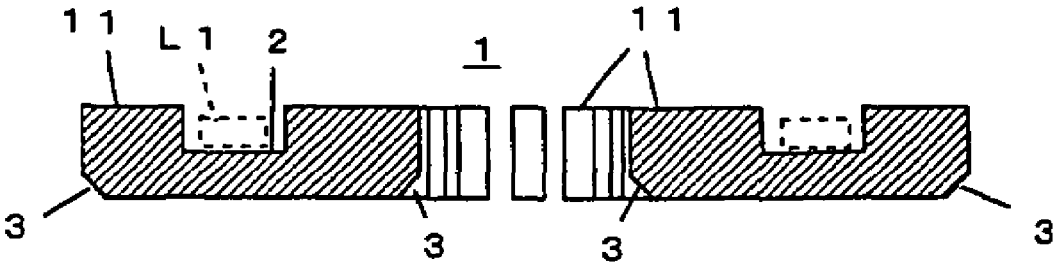

FIG. 5 shows the second embodiment in the present invention. Paying attention to the difference from the first embodiment, the noncontact coupler of the second embodiment is formed with a plurality of long rectangular core members 1, 1, as shown in the FIG. 5-A and FIG. 5-B, wherein the primary and the secondary magnetic cores are arranged radially to form a circle.

Figure 6:
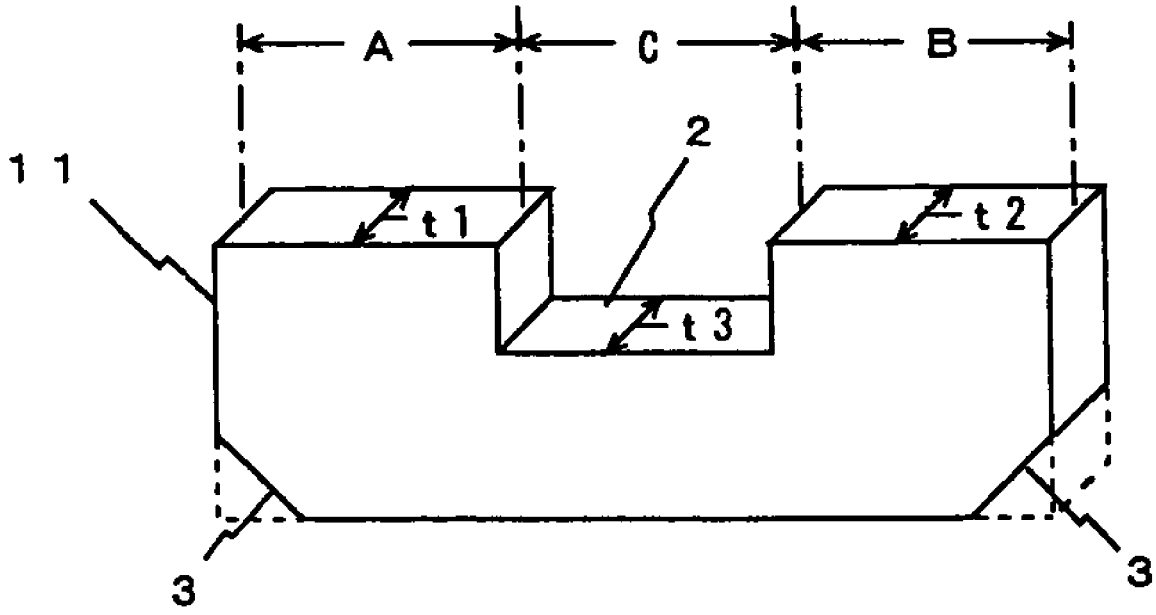
FIG. 6 is a perspective view of a part of the magnetic core shown in FIGS. 5A and 5B.

Each long rectangular core member 11 is formed into a plate shape having a uniform thickness as a whole (sections A, B, C as shown in FIG. 6 (t1=t2=t3). The core member 11 shaped like this is effective for uniform pressure forming. Therefore, uniformity and stability of properties of the core members can be improved by means of optimizing the conditions in forming and burning. Moreover, each of the core members 11 provides a U-shaped open magnetic path, and equalizing the areas (t1×A, t2×B) of the U-shaped open magnetic path at the both end surfaces (t1×A=t2×B) enable to optimize the magnetic path balance in the core members 11 and to decrease a core loss.

Third Embodiment

Figure 7A:
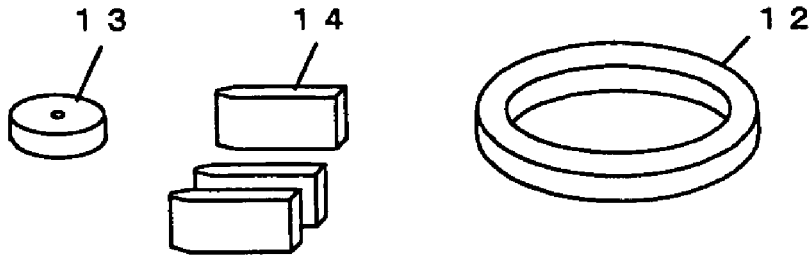
FIGS. 7A–7C show a perspective view, a plan view, and a cross-sectional view of the third embodiment of the noncontact coupler in the present invention respectively.
Figure 7B:
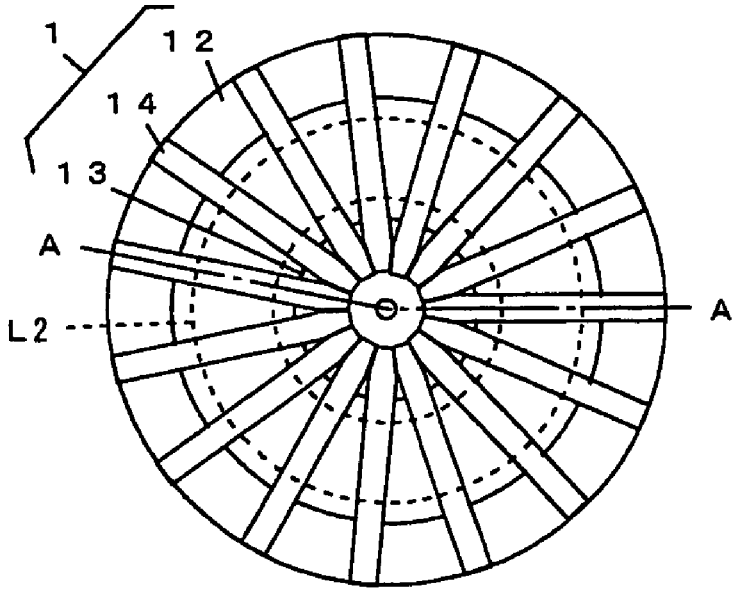
Figure 7C:
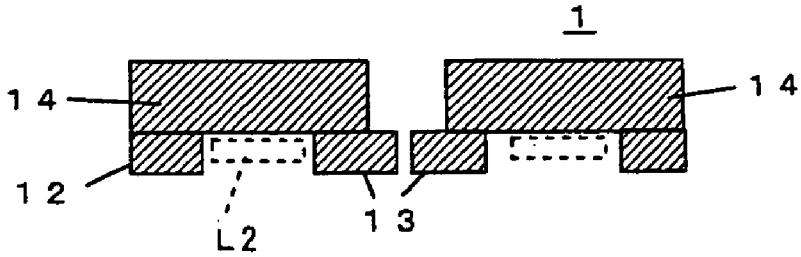

FIG. 7 shows the third embodiment of the noncontact coupler in the present invention. In this embodiment, the noncontact coupler employs the magnetic cores 1 as assembled as shown in FIG. 7-B, FIG. 7-C, using three kinds of core members 12, 13, 14 as shown in FIG. 7-A. This magnetic core 1 are formed from outer circumferential core members 12, disc-shaped inner circumferential core members 13, and a number of intermediate core members 14 arranged radially to form a circle connecting both of the core members 12, 13. This arrangement enables to decrease a variation in a cross section in the direction of the magnetic path, namely, to improving the balance of magnetic path and to reduce the core loss while the weight of the core 1 is reduced.

Figure 8A:
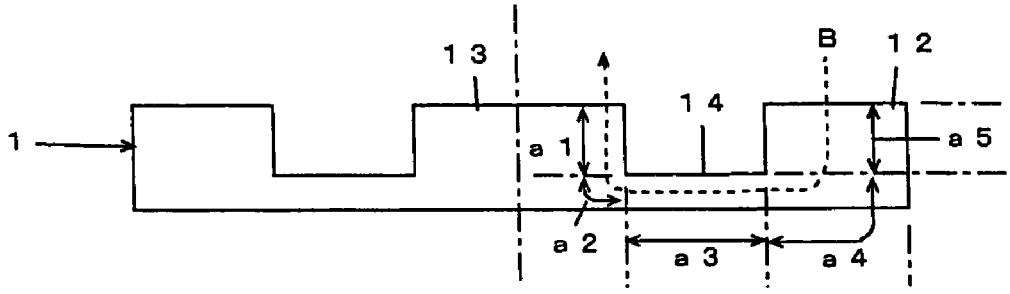
FIGS. 8A and 8B are analytical views illustrating a state of a cross-sectional area of the magnetic path of the core shown in FIG. 7.
Figure 8B:
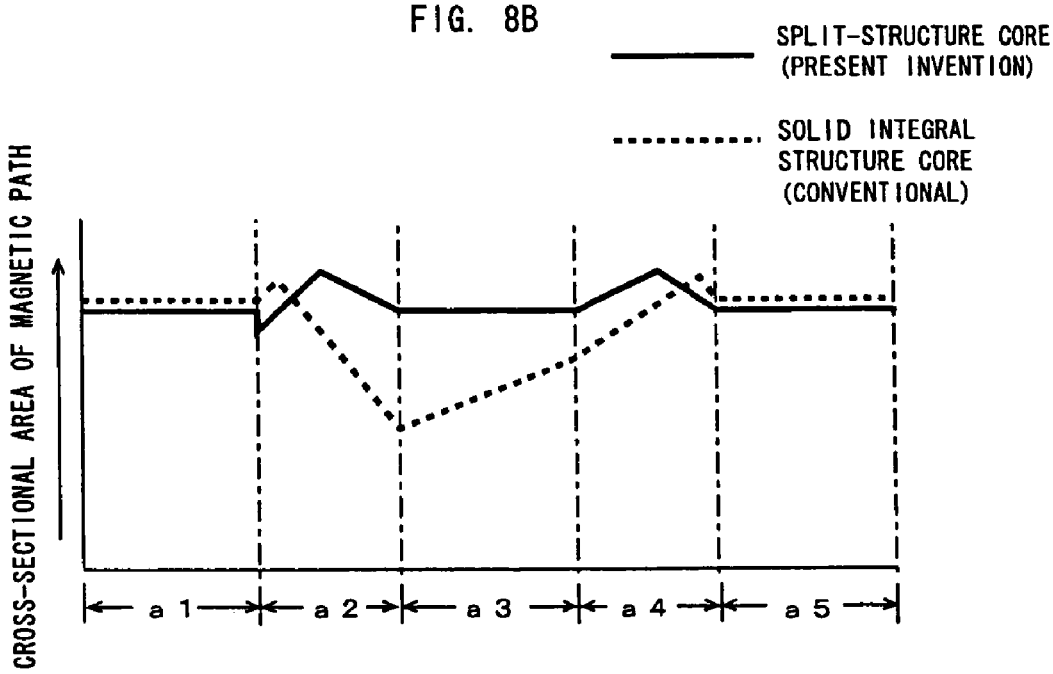

FIG. 8 shows analysis of a cross section of the magnetic path in the core 1 shown in FIG. 7. The core 1 shown in FIG. 7 has the outer circumferential core members 12, the inner circumferential core members 13, and the middle core members 14, and forms the U shaped open magnetic paths. The U shaped open magnetic path can be divided into sections a1–a5. The cross sections of the magnetic path at the sections a1–a5 are indicated by solid lines in the FIG. 8-B.

Figure 11A:
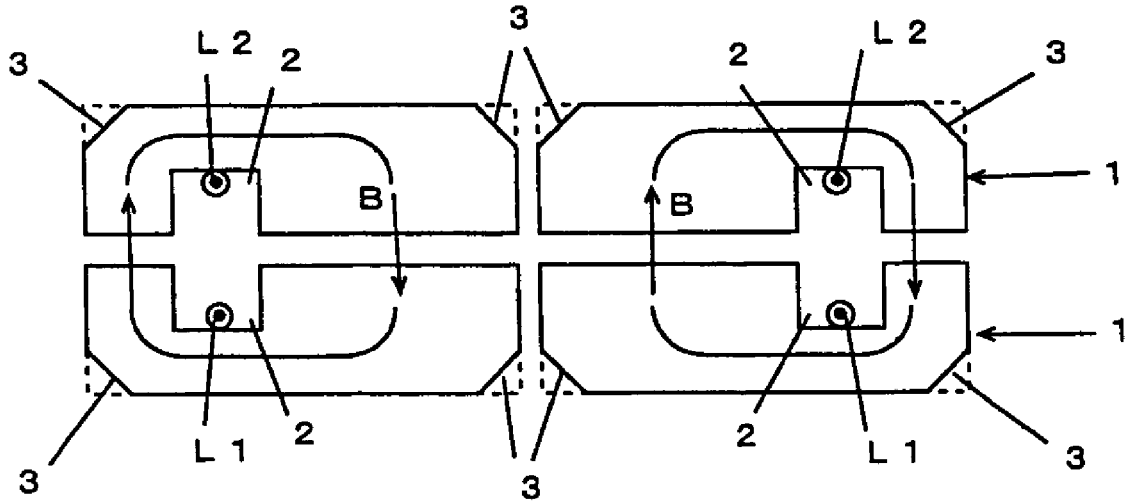
FIGS. 11A and 11B show a cross-sectional view and a cutaway perspective view of the fifth embodiment of the noncontact coupler in the present invention respectively.
Figure 11B:
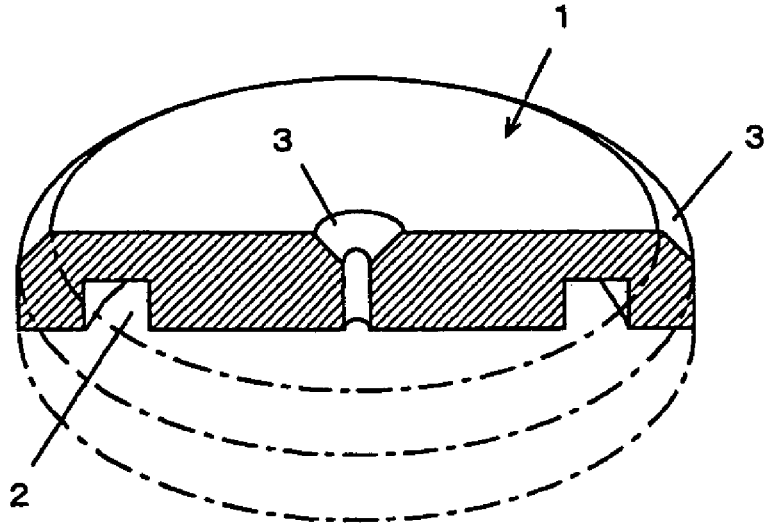

In FIG. 8-B, the broken line shows the change of cross sections of a magnetic path in corresponding portion of the prior integral-type core shown in FIG. 11. Comparing these graphs with each other, it can be understood that the core 1 shown in FIG. 7 can be improved to reduce changes of the cross section of the magnetic path, i.e., steps in the cross section, by choosing such as a shape or a size of the respective outer circumferential core members 12, inner circumferential core members 13, and middle core members 14. This will provide the effects of keeping appropriate balance in a magnetic path and reducing the core loss.

Figure 9A:
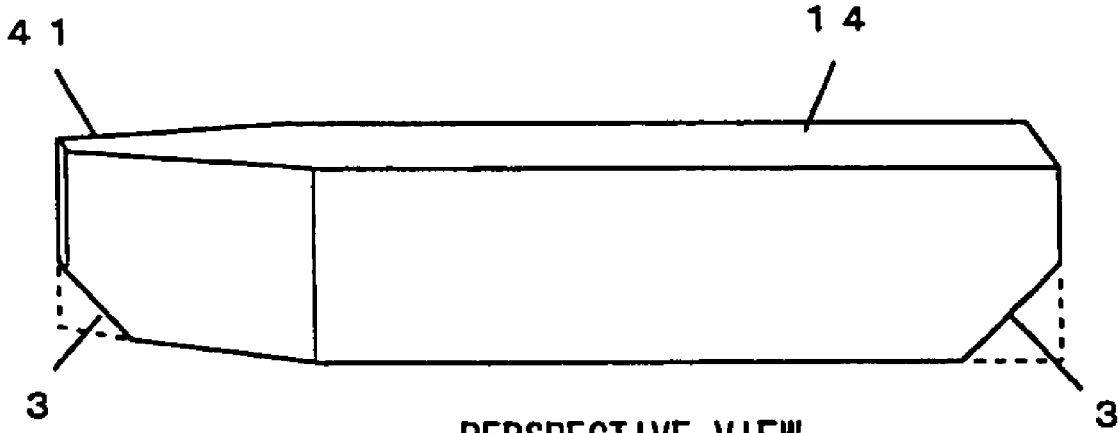
FIGS. 9A–9B respectively show a perspective view and a cross-sectional view of an embodiment of the intermediate core member constituting a part of the core shown in FIGS. 7A–7C.
Figure 9B:
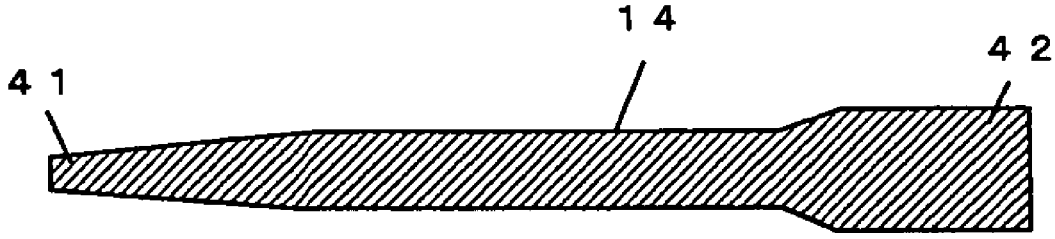

FIGS. 9A and 9B show preferred embodiment of the middle core member 14. The middle core member 14, shown in a perspective view of FIG. 9A, has a taper 41 on the inner circumferential side edge (at the member 13 side). And the middle core member 14 shown in the FIG. 9-A by cross section view has a wider end 42 at the end of the outer circumference (at the member 12 side) in addition to the taper 41. In FIG. 8, the cross section of the magnetic path indicated by the solid line changes discontinuously near the borderline of the section a1 and the section a2, however this discontinuous change can be relieved by means of using the middle core members 14 shaped as shown in FIGS. 9A, 9B.

Fourth Embodiment

Figure 10A:
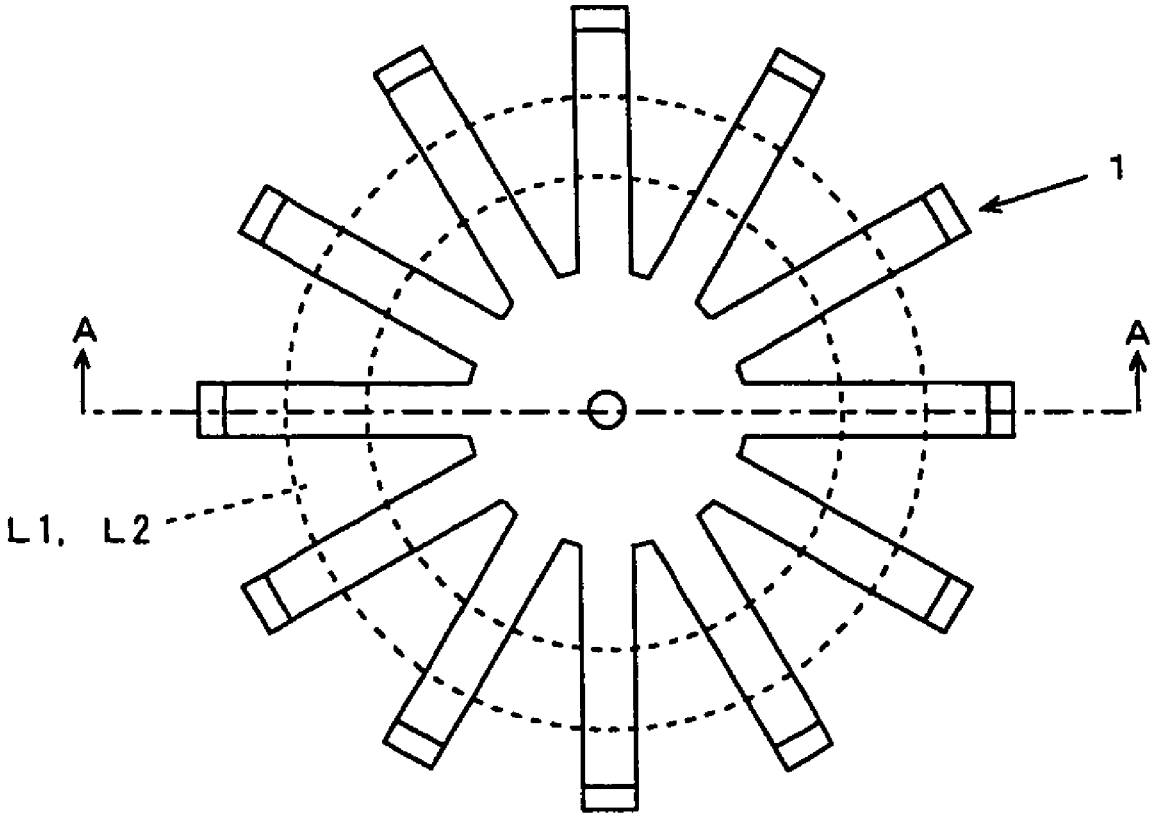
FIGS. 10A–10B are a perspective view and a cross-sectional view of the fourth embodiment of the noncontact coupler in the present invention respectively.
Figure 10B:
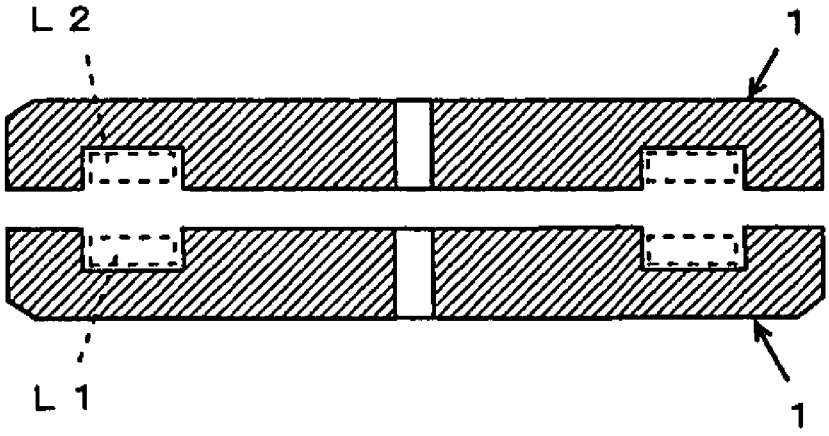

FIGS. 10A and 10B show the fourth embodiment of the noncontact coupler of the present invention. In this embodiment, as shown in the figures, only the opposing surfaces of the magnetic cores 1, 1 are split, and the core 1 as a whole is of a continuous integral-type. This structure can also achieve the first and second objects.

Fifth Embodiment

FIGS. 11A and B show the fifth embodiment of the noncontact coupler of the present invention. In this embodiment, the prior disc-shaped magnetic core is just only beveled at the non-facing corners thereof (FIG. 12). However, only having beveled at the corners 3 provides the effect of decreasing a weight of the noncontact coupler and reducing a core loss with improvement of the balance of the magnetic path.

Sixth Embodiment

Figure 12A:
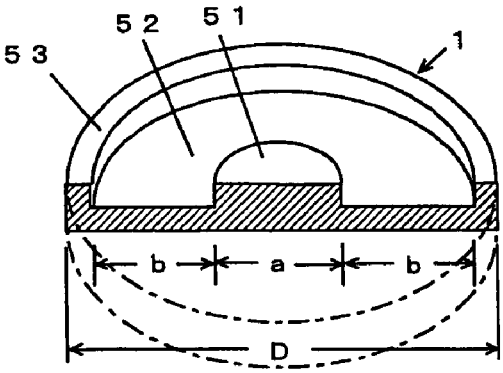
FIGS. 12A–12D show a group of various views illustrating the sixth embodiment of the noncontact coupler in the present invention.
Figure 12B:
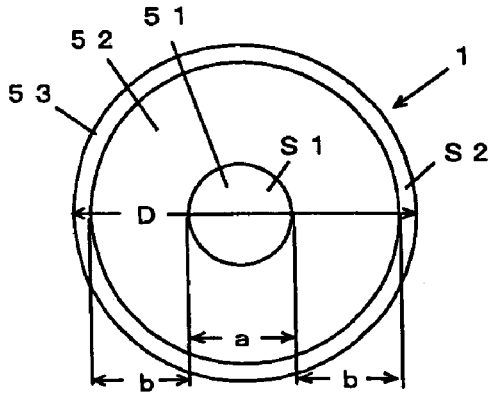
Figure 12C:
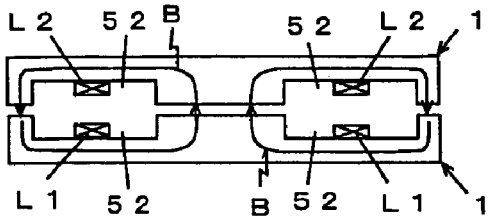
Figure 12D:
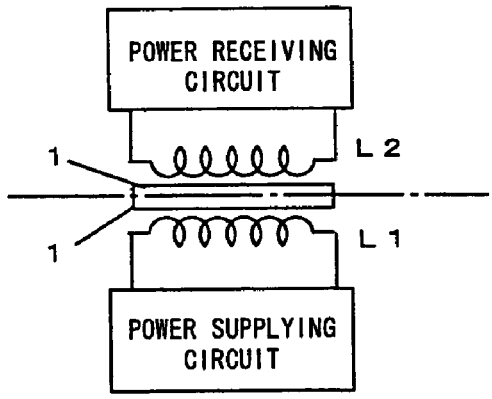

FIGS. 12A–12D show the sixth embodiment of the noncontact coupler of the present invention. In this figures, FIG. 12A shows a cross-sectional perspective view of the magnetic core 1, FIG. 12B is a plan view of FIG. 12A, FIG. 12C is a cross-sectional view of the noncontact transmit coupler using the core 1, and FIG. 12D is an equivalent circuit to FIG. 12C.

The coupler shown in the figures is basically the same as the prior ones in that a pair of magnetic cores 1, 1 around which the coils L1, L2 are wound are closely faced to each other at the magnetic face sides of both the cores in proximity. The open magnetic path formed by each of the cores 1, 1 are connected across the gap (a spatial magnetic path), and forms a circular closed magnetic path. And these closed magnetic paths enable to transmit AC (high frequency) power from one coil L1 of the core 1 to the other coil L2 of the other core 1.

The magnetic core 1 is integrally formed in a disc shape with a ferrite magnetic body or the like. On one side of the disc-shaped magnetic core 1, a circular groove 52 is formed in order to wind (house) the coils L1, L2 and to form a U shaped open magnetic path detouring around the circular groove 52. Inside the annular groove 52 is formed a medium leg 51 to form one side of the magnetic pole surface of the U shaped open magnetic path. On the other hand, outside the annular groove is formed the annular outer leg 53 to form the other side of the magnetic pole surface of said U-shaped open magnetic path.

In this embodiment, a diameter "a" of the medium leg 51 and a width "b" of the annular groove is made to be nearly equal. In so far, an annular groove that does not form a magnetic pole surface has only the smallest width as required as a winding space for the coils in view of increasing the magnetic coupling coefficient when the primary and secondary cores are faced to each other. Therefore the width "b" of the annular groove 52 has been further smaller than the diameter "a" of the medium leg 51 (a>b). In this embodiment, however, the width b of the annular groove 52 is nearly equal to the diameter "a" of the medium leg 51 (a=b). Namely, in the noncontact transmit coupler, compared to the prior art, the width "b" of the annular groove is further enlarged relatively.

In the case that the width b of the annular groove 52 is relatively enlarged, the diameter of the medium leg 51 "a" becomes relatively smaller, accordingly the magnetic pole surface of the core 1 decreases. It has been considered that the decrease of the magnetic pole surface causes the decrease of the coefficient of magnetic coupling. However, according to what the present inventors have understood, it has been clear that the coefficient of magnetic coupling does not greatly decrease, when the width b of the annular groove and the diameter of the medium leg "a" is nearly equal. Even though there arose a displacement in positioning the primary and the secondary cores 1, 1, it has become possible to decrease reduction of the magnetic coupling coefficient due to the displacement. Namely, handleability with respect to the tolerance for the primary and secondary core positioning of the noncontact transmit coupler can be improved by making the width b of annular groove and the diameter a of the medium leg equal.

Figure 13:
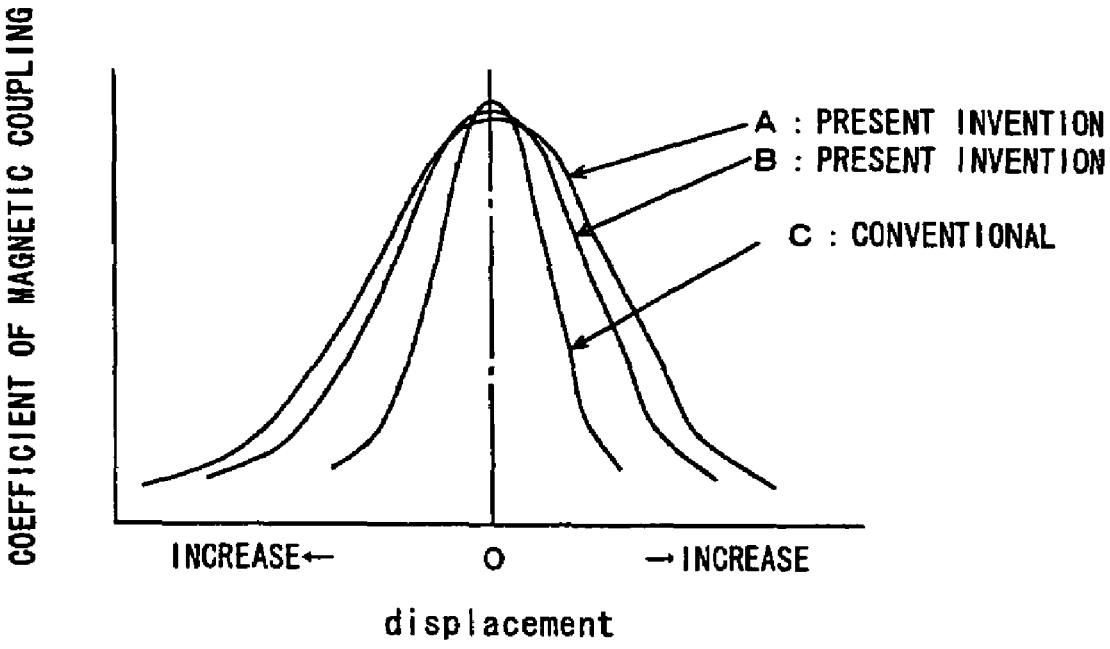
FIG. 13 is a characteristic curve showing a state of variation of a magnetic coupling coefficient for a displacement of the core in relation to FIGS. 12A–12D.

FIG. 13 shows a relationship between the coefficient of magnetic coupling and the displacement of the core 1, 1 in respective shapes of the core. As shown in this figure, the prior noncontact transmit coupler, wherein the width b of the annular groove is formed smaller than the diameter a of the medium leg, shows relatively high magnetic coupling coefficient when the primary and secondary cores are accurately positioned when piled up, while when the displacement in the positioning arises, the coefficient of the magnetic coupling is drastically reduced because of the displacement. On the other hand, in the noncontact transmit coupler according to the present invention, wherein the width b of the annular groove is formed in almost the same size as the diameter a of the medium leg, decrease of the coefficient of magnetic coupling is relatively moderate in the case that the displacement exists. Therefore, power transmitting in high efficiency can be achieved by the noncontact method in the case positioning of the cores 1, 1 is more or less displaced since practically sufficient state of magnetic coupling is provided.

Change in the coefficient of magnetic coupling against the displacement is optimized in the case the diameter a of the medium leg and the width b of the annular groove become substantially equal (a=b). However it has been proved that the diameter a of the medium leg and the width b of the annular groove can be practically tolerated within a=b±20% with respect to the displacement.

The following reasons can be considered, for example, for why the above stated effect of the tolerance to the displacement has been provided. Namely, in the prior cores 1', 1' shown in FIG. 17A, in the case the displacement (a lateral displacement) h arises between the pair of cores 1', 1' facing to each other, the medium leg 51 of the one core 1' covers substantially over the both outer side portions of the annular groove 52 of the other core 1'. Therefore, such magnetic paths B' that have no contribution to the magnetic coupling are formed in that a magnetic flux from the medium leg 51 of the one core 1' circulates through the outer leg 53 and the medium leg 51 of the other core 1', to the medium leg 51 of the one core 1', as shown in the figure with a trace of an arrow. The magnetic path B' like this causes decrease of the coupling coefficient between the coils L1 and L2.

Figure 14:
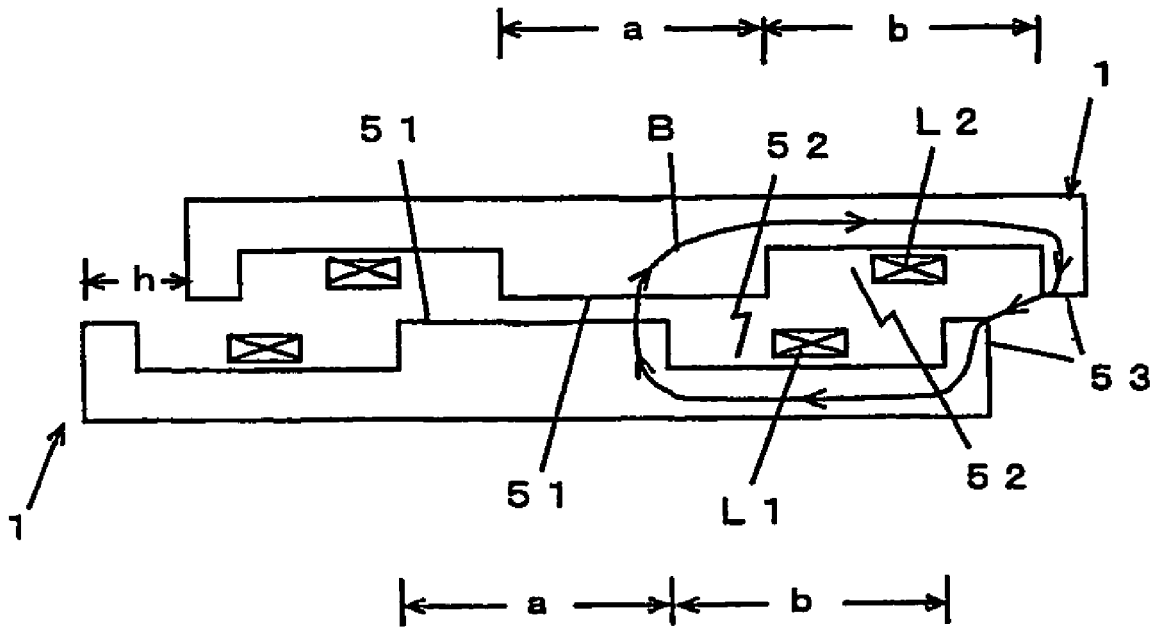
FIG. 14 is a cross-sectional schematic view showing a state of magnetic coupling in relation to FIGS. 12A–12D where a displacement of the cores exists.

In order not to be formed the magnetic path B' stated above, in other words, so as to avoid forming the magnetic path B' in that a magnetic flux circulates from one medium leg 51 and returns to the medium leg 51 itself, as shown in FIG. 14, in the case of a little displacement h arises, the core size should be arranged in order not to cover the both sides of the annular groove 52 of the other core 1 by the medium leg 51 of the core 1, in other words, making the diameter a of the medium leg and the width b of the annular groove almost equal is the best core shape.

Further, in addition to the above-mentioned structure, in the noncontact transmit coupler shown in FIGS. 12A–12D as an embodiment, the magnetic pole surface area S1 formed with the medium leg 51 and the magnetic pole surface area S2 formed with the annular outer leg 53 are formed so that the areas are almost equal to each other. In short, the area S1 of the upper end of the medium leg 51 and the area S2 of the upper end of the outer leg 53 are made almost equal (S1=S2). This enables to uniform the cross section along the whole length of the magnetic path formed with both of the primary and secondary cores 1, 1 and to reduce variation of the magnetic flux distribution along the closed magnetic path. Namely, a good balance of the magnetic path is obtained in which variation of a magnetic flux density in the closed magnetic path is small. It has been known that the core loss is increased in proportion to the 2.4th power of the magnetic flux density. Therefore, the core loss can be minimized when a good balance of the magnetic path is achieved.

In order to equalize the area of the medium leg 51 with that of the outer leg 14, the outside diameter D and the diameter a of the medium leg 51 can be given as follows.

Namely, when the diameter a of the medium leg 51 is set equal to the width b of the annular groove 52 (a=b), the respective areas S1, S2 of the medium leg 51 and the outer leg 53 are given by the following formulas (1), (2):

$$S1 = \left(\frac{a}{2}\right)^2 \pi \tag{1}$$

$$S2 = \left(\left(\frac{D}{2}\right)^2 - \left(\frac{3a}{2}\right)^2\right)\pi \tag{2}$$

From the formulas (1), (2), in order to equalize S1 with S2, a is expressed by D as follows:

$$\frac{a^2}{4} = \frac{D^2}{4} - \frac{9a^2}{4}$$

$$10a^2 = D^2$$

$$a^2 = \frac{D^2}{10}$$

$$a = \sqrt{\frac{D}{10}}$$

If a is equal to b, then the formula (3) should hold:

$$a = b = \sqrt{\frac{D}{10}} \quad (3)$$

The formulas (1)–(3) are conditions to get optimum state. However, in practice, it has been proved that almost similar effects can be obtained even if an error within ±20% from the formulas (1)–(3) is permitted.

Figure 15A:
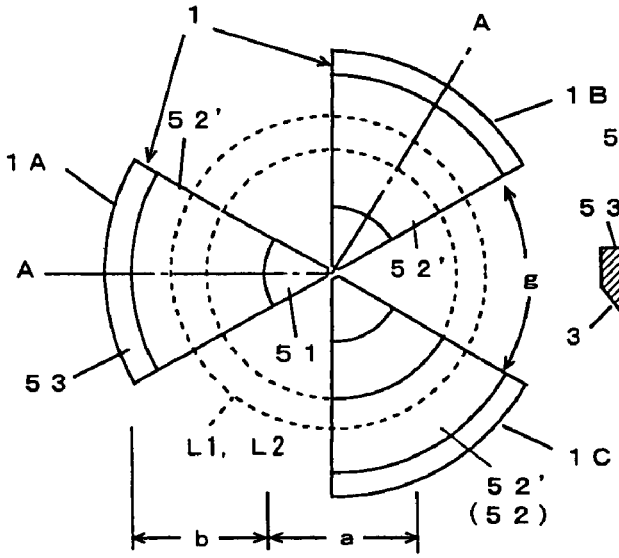
FIGS. 15A–15E show a group of various views of the seventh embodiment of the noncontact transmit coupler in the present invention.
Figure 15B:
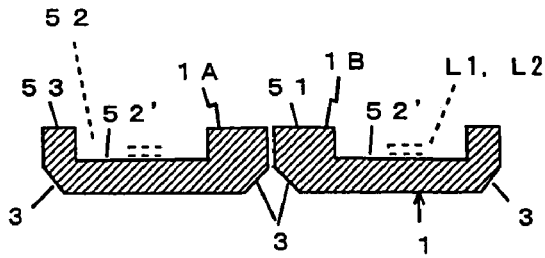
Figure 15C:
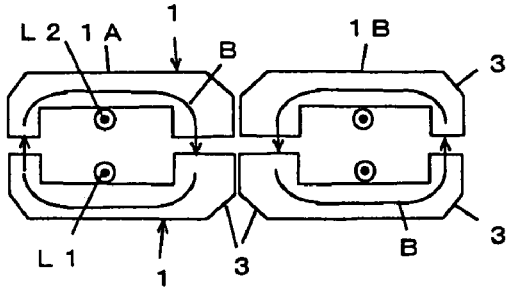

The embodiment stated above shows only the disc-shaped integral-type magnetic core, however in the present invention, the split core can be used as shown in FIG. 15A.

Seventh Embodiment

FIGS. 15A–15E show the seventh embodiment of the noncontact transmit coupler according to the present invention. The noncontact transmit coupler according to the embodiment forms the primary and secondary magnetic cores 1, 1 with the fan-shaped core members 1A, 1B, and 1C (central angle=60°), and gaps having the same fan shape as the core members are interposed between each of the core members 1A, 1B, and 1C (g=60°). Each core member 1A, 1B, and 1C has a partial annular groove 52' on one side to form a U-shaped open magnetic path. This partial annular groove 52' corresponds to the annular groove 52.

Figure 15D:
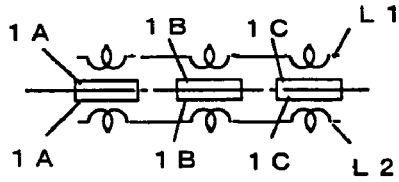
Figure 15E:
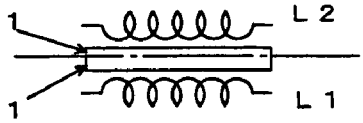
Figure 16A:
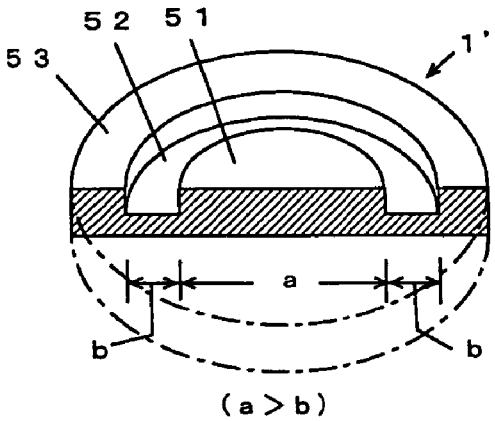
FIGS. 16A–16D show a group of various views of the structure of a conventional noncontact transmit coupler.
Figure 16B:
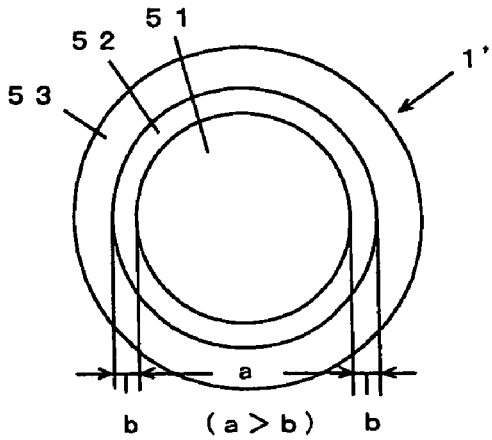
Figure 16C:
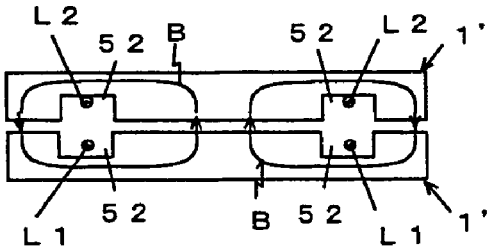
Figure 16D:
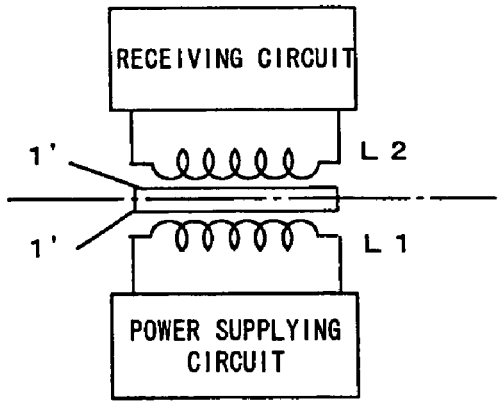

The primary magnetic core members 1A, 1B, and 1C and the secondary core members 1A, 1B, and 1C are opposed in proximity to each other at open magnetic path sides to form an annular closed magnetic path B and form a noncontact transmit coupler in which AC (high frequency) power is transmitted between the primary coil L1 and the secondary coil L2. In this case, both of the primary and the secondary core members 1A—1A, 1B—1B, and 1C—1C are magnetically coupled and form an equivalent transformer circuit as shown in FIG. 15D or 15E.

In this way, the noncontact transmit coupler is formed wherein the primary and the secondary magnetic cores 1, 1 are split, and the gaps g for forming a spatial magnetic path (a magnetic path formed in space) is interposed between the split parts. According to the noncontact transmit coupler, the core 1, 1 can be reduced in weight corresponding to the fan-shaped gaps (g=60°).

The non-opposing corners of each of the core members 1A, 1B, and 1C are beveled in advance. The symbol 3 indicates the bevels. The cores 1, 1 are further lightened by means of forming the bevels, and have good durability against damage at the edge of the core. The core members are made of a ferrite magnetic body produced by pressure forming and burning, however the ferrite magnetic body is vulnerable to damage during the producing, transporting, or assembling processes because of its brittleness. The bevels 3 are effective to prevent such damage. In addition, a large-sized ferrite core has such difficulty in producing as to applying uniform pressure during the pressure forming process and easy to crack during the burning process. These problems are solved by means of splitting the core described above.

Moreover, in the case the primary and the secondary magnetic cores 1, 1 are split, the magnetic coupling between the primary core 1 and the secondary core 1 is made in every direction, and the substantial opposing surface area of the cores 1, 1 between the primary and the secondary cores are enlarged, and the substantial opposing surface is to be maintained even when the displacement occurs. Namely, the primary and the secondary magnetic coupling can be properly maintained even if the area of the directly opposing surface of the cores is reduced because of the displacement. The magnetic coupling enables the noncontact transmit coupler to be lightened while securing its performance, and to be improved in handleability with enhanced tolerance for the positioning of the primary and the secondary cores.

The disc-shaped magnetic cores 1, 1 include the disc-shaped cores constituting a circle as a whole, having more than one core members 1A, 1B, and 1C with gaps g therebetween.

The above stated description explains some embodiments of the present invention, but the present invention should not be limited only to the embodiments. The present invention can be used as a coupler not only for transmitting electric power but also for transmitting signals.

INDUSTRIAL APPLICABILITY

According to the present invention, for example, splitting at least the sides facing to each other of the primary and secondary magnetic cores 1, 1, and interposing the gaps for forming a spatial magnetic path between the split pieces provide effects of weight reduction of the noncontact coupler while securing its performance, further, improving handleability with enhanced tolerance for the positioning of the primary and secondary cores.

Moreover, the present invention is capable of improving a magnetic path balance and reducing a core loss by means of constituting the primary and the secondary magnetic cores with the outer annular core members, disc shaped inner core members, and a number of intermediate core members arranged radially to form a circle with connecting between both of the outer and inner core members.

Further, beveling each of the non-opposing corners of each core member provides effects of lightening the core, namely lightening the noncontact coupler, and reducing the core loss by improving the balance in the magnetic path.

Further, in the present invention, when the pair of disc shaped magnetic cores having the annular groove for winding the coil on each of the one side thereof is used, the diameter of a medium leg positioned inside the annular groove is set almost equal to the width of the annular groove. This arrangement provides effects of improving handleability by enhancement of tolerance for the primary and the secondary core positioning.

The magnetic core stated above may be of disc-shaped integral-type, or may be formed with a plurality of split cores to form disc shape as a whole. In the case the magnetic core is formed with many split cores and has disc shape as a whole, the fan-shaped gaps can be made between each of the split cores. These fan-shaped gaps provide effects of lightening a core and the magnetic coupling coefficient can be maintained high when a displacement exists.

The magnetic core can be formed with the ferrite magnetic aterial. Further, beveling the non-opposing corner of the magnetic core enables to lighten the core and reduce the risk of damage at the edge of the core. Moreover, these steps provide effects of lightening the noncontact coupler and reducing the core loss by improving the balance in the magnetic path.

The invention claimed is:

1. A noncontact coupler comprising a pair of magnetic cores each having a U-shaped open magnetic path, a primary coil and secondary coil being wound around said cores separately respectively, said coupler transmitting AC electric power between said primary and secondary coils by means of an annular closed magnetic path formed by opposing in proximity both open magnetic face sides of said cores, wherein each of the primary and secondary magnetic cores is split laterally into sections, and gaps through each of which part of a spatial magnetic path passes are interposed between adjacent ones of said split sections.

2. A noncontact coupler according to claim 1, wherein each of said primary and secondary magnetic cores is formed by a plurality of core members and gaps through each of which part of a spatial magnetic path passes are interposed between adjacent ones of said core members.

3. A noncontact coupler according to claim 1, wherein each of said primary and secondary magnetic cores is formed by fan-shaped core members and fan-shaped gaps having the same shape as said core members are interposed between adjacent ones of said core members.

4. A noncontact coupler according to claim 1, wherein each of said primary and secondary magnetic cores is formed by a plurality of elongated magnetic members extending radially and arranged around a circle.

5. A noncontact coupler according to claim 4, wherein said elongated magnetic member is board-shaped and has uniform thickness entirely.

6. A noncontact coupler according to claim 1, wherein said primary and secondary magnetic cores are formed respectively by the same odd numbers of core members extending radially and arranged at equiangular intervals, and said primary core members and secondary core members are arranged such that each core member of one of the primary and secondary magnetic cores is placed level with one of the gaps between adjacent ones of the core members of the other to form a magnetic coupling between said primary and secondary coils with the arrangement.

7. A noncontact coupler comprising a pair of magnetic cores each having a U-shaped open magnetic path, a primary coil and secondary coil being wound around said cores separately respectively, said coupler transmitting AC electric power between said primary and secondary coils by means of an annular closed magnetic path formed by opposing in proximity both open magnetic face sides of said cores, wherein each of the primary and secondary magnetic cores is formed by an annular outer circumferential core member, a disc-shaped inner circumferential core member, and a number of intermediate core members extending radially that bridge between both said circumferential core members.

8. A noncontact coupler according to claim 7, wherein an inner circumferential edge of each said intermediate core member is tapered.

9. A noncontact coupler according to claim 7, wherein an outer circumferential edge of each said intermediate core member is broadened in the width.

* * * * *